US005131647A

United States Patent [19]

Henn et al.

[11] Patent Number: 5,131,647

[45] Date of Patent: Jul. 21, 1992

[54] SHEET FEEDER FOR PRINTING MACHINES AND THE LIKE

[75] Inventors: Manfred Henn, Heidelberg; Udo Ganter, Hirschberg-Leutershausen, both of Fed. Rep. of Germany

[73] Assignee: Heidelberger Druckmaschinen AG, Heidelberg, Fed. Rep. of Germany

[21] Appl. No.: 682,584

[22] Filed: Apr. 8, 1991

[30] Foreign Application Priority Data

Apr. 6, 1990 [DE] Fed. Rep. of Germany ..... 4011286

[51] Int. Cl.[5] ..... B65H 31/32

[52] U.S. Cl. ..... 271/18.9; 271/183; 271/218

[58] Field of Search ..... 271/189, 218, 209, 213, 271/183

[56] References Cited

U.S. PATENT DOCUMENTS

| | | | |
|---|---|---|---|
| 2,106,199 | 1/1938 | Wormser | 271/189 X |
| 2,785,894 | 3/1957 | Reinartz | 271/189 X |
| 2,836,418 | 5/1958 | Blättner et al. . | |
| 3,966,195 | 6/1976 | Simeth . | |

FOREIGN PATENT DOCUMENTS 3609549 10/1989 Fed. Rep. of Germany .

*Primary Examiner*—Richard A. Schacher

*Attorney, Agent, or Firm*—Herbert L. Lerner; Laurence A. Greenberg

[57] ABSTRACT

A sheet delivery for a printing machine or the like with a device for changing a sheet pile while the machine is in operation, includes suction-type grippers insertable into a sheet feeder, opposite to a conveying direction of the sheets and between pile stops for a leading edge of the sheets, the suction-type grippers having a device for gripping by suction, in an inserted end position of the grippers, the leading edge of a sheet deposited onto the suction-type grippers and for holding the sheet at a distance above the sheet pile in an auxiliary-pile position, so as to permit the insertion of an auxiliary-pile device beneath the sheet, and a device for stretching the sheet after the leading edge of the sheet has been gripped by the inserted suction-type grippers, the sheet-stretching device being effective for withdrawing the suction-type grippers a predetermined distance towards the pile stops for the leading edge of the sheet.

8 Claims, 9 Drawing Sheets a
5
13
13
3
10
37
4
3a

SHEET FEEDER FOR PRINTING MACHINES AND THE LIKE

Figure 1A:
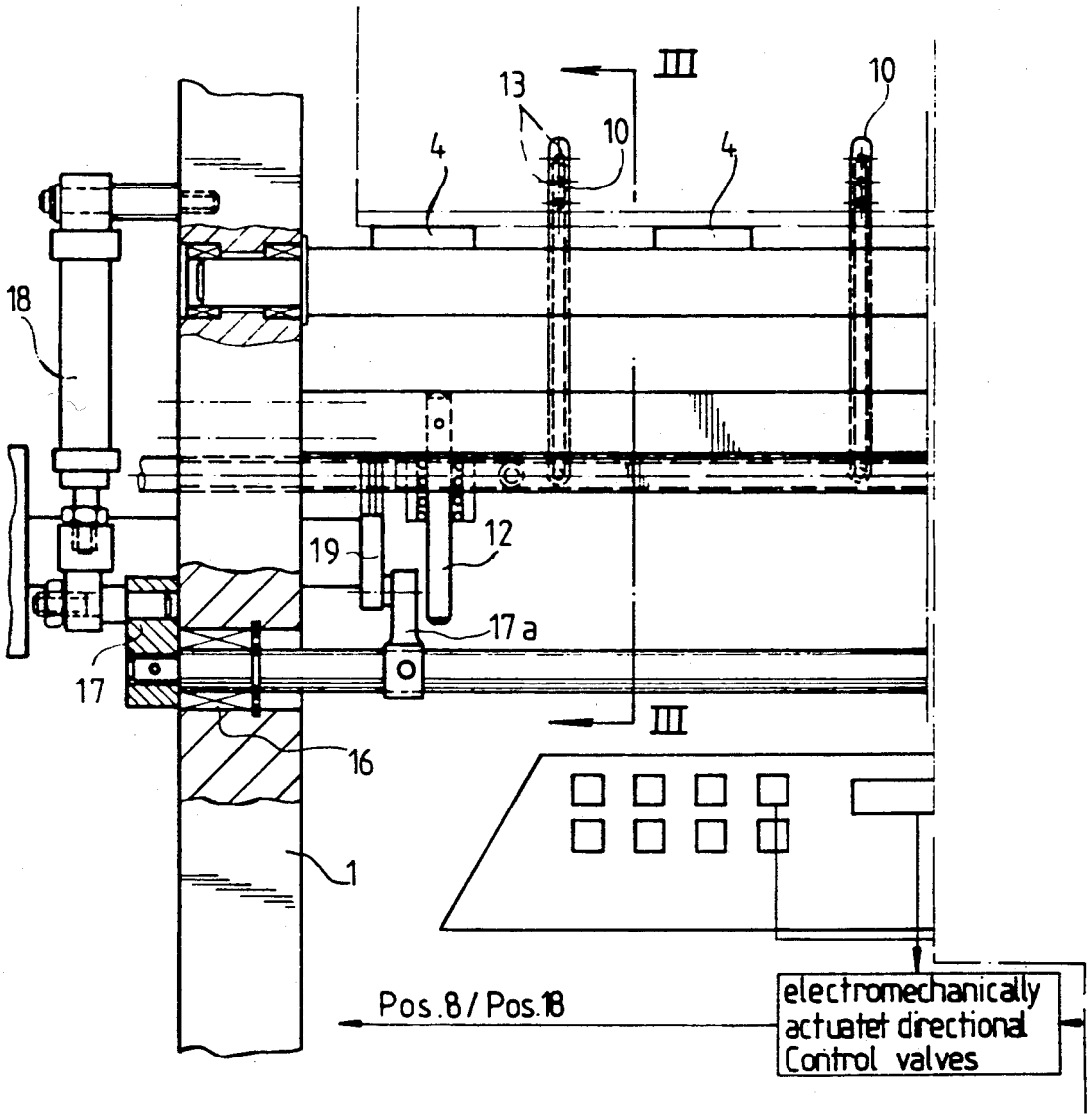

The invention relates to a sheet delivery for printing machines or presses with a device for changing a sheet pile while the printing machine or press is in operation.

It has been known heretofore from German Patent 921 154 that suction-type grippers are insertable into a feeder, in a direction opposite to the conveying direction of sheets, between pile stops for the front or leading edge of a sheet, the suction-type grippers, when in the inserted and position, gripping by suction the front or leading edge of the sheet deposited onto the suction-type grippers and holding the sheet at a distance or spacing above the sheet pile in an auxiliary-pile position which permits the insertion of a flyer or rake, or an auxiliary-pile table or the like. In so-called non-stop operation, when the pile is being changed, these suction-type grippers are inserted above the sheet pile in order to form an auxiliary pile, so that the next incoming sheet is deposited with its front edge onto the suction-type grippers, is tightly held by the latter, and all following sheets are deposited thereon. The oncoming sheets then collect in an auxiliary pile on a flyer or rake, auxiliary-pile table or the like, which has been inserted into the gap between the by then somewhat lowered sheet pile and the sheet raised therefrom by its front region, so that the main pile can be changed while the printing machine is in operation. A purpose of the suction-type grippers is to prevent the bottom sheet from slipping from the catching device for the front or leading edge of the sheet when the gap is being formed and, in particular, when the flyer, rake or the like for the auxiliary pile is being inserted.

A further phenomenon occurs in that, with the sheet pile lowered, the sheet which is held up only by its front or leading edge sags and otherwise supports itself on the lower-lying sheet pile. The sheet, consequently, becomes shorter and is no longer in contact with the pile stops. Furthermore, in the case of certain, primarily lightweight, grades of paper, the bottom sheet of the auxiliary pile may sag into the gap, be slightly entrained by the flyer as it is inserted and thus partially slip from the catching device for the front or leading edge, with the result that it no longer touches the pile stops. This is undesired with respect to accuracy or precision in the further processing of the sheets.

From German Published Non-Prosecuted Application (DE-OS) 23 01 840, a sheet delivery has become known in which, during the formation of the auxiliary pile for changing the pile in non-stop operation, not only catch fingers for the front or leading edge of a sheet are conveyed against retractable pile stops, but also, in the opposite direction to the catch fingers for the front or leading edge of the sheet. Upholders for the rear or trailing edge of the sheet are briefly insertable above the sheet pile, the upholders, in conjunction with the catch fingers for the front or leading edge of the sheet, holding up the next incoming sheet in the case of a loose run, so that it is possible to insert the flyer, rake or the like for the auxiliary pile.

It is accordingly an object of the invention to provide a sheet delivery in which a sheet is safely and securely held by the catch fingers briefly in order to form the auxiliary pile and, after an auxiliary-pile device, such as a flyer or rake has been inserted, the sheet is tautened or stretched and, in doing so, is pushed against the pile stops particularly with its front or leading edge in order to ensure its precise alignment in the sheet pile.

With the foregoing and other objects in view, there is provided, in accordance with the invention a sheet delivery for a printing machine or the like with a device for changing a sheet pile while the machine is in operation, comprising suction-type grippers insertable into a sheet feeder, opposite to a conveying direction of the sheets and between pile stops for a leading edge of the sheets, the suction-type grippers having means for gripping by suction, in an inserted end position of the grippers, the leading edge of a sheet deposited onto the suction-type grippers and for holding the sheet at a distance above the sheet pile in an auxiliary-pile position, so as to permit the insertion of an auxiliary-pile device beneath the sheet, and means for stretching the sheet after the leading edge of the sheet has been gripped by the inserted suction-type grippers, the sheet-stretching means being effective for withdrawing the suction-type grippers a predetermined distance towards the pile stops for the leading edge of the sheet.

Due to this construction, the sheet, which is shortened by a differential distance due to its sag and which falls short of the pile stops for the front or leading edge of the sheet, is corrected by the differential distance and is simultaneously tautened or stretched, so that it is again precisely aligned in the sheet pile.

In accordance with another aspect of the invention, there is provided a sheet delivery for a printing machine or the like with a device for changing a sheet pile while the machine is in operation, comprising first suction-type grippers formed as catch fingers for a leading edge of a sheet and being insertable between pile stops of the sheet, and second suction-type grippers formed as catch fingers for a trailing edge of the sheet, both the first and the second suction-type grippers being insertable above a sheet pile parallel to a conveying direction of the sheet and having means for gripping and holding, in an inserted end position of both the first and the second suction-type grippers, a sheet deposited at its leading and trailing edges thereon, for forming an auxiliary pile above the sheet pile, the first and the second suction-type grippers having suction nozzles at upper sides thereof whereon the sheet edges are deposited, and having sheet-stretching means for withdrawing the first and the second suction-type grippers from the inserted end position thereof a given distance in a direction opposite to the direction of insertion thereof.

In this case, when an auxiliary pile is being formed, the oncoming sheet is deposited on catch fingers not only at the front or leading edge of the sheet but also at the rear or trailing edge of the sheet, the catch fingers being connected, when in the inserted end position, to the suction air of the suction-air system of the printing machine for pressing and tightly holding the leading and trailing edges of the sheet, the sheet being acted upon both at its leading and its trailing edges by means for tautening the sheet. This increases the accuracy in the aligning of the bottom sheet in the auxiliary pile at the pile stops for the leading edge of the sheet and for the trailing edge of the sheet. Furthermore, the bottom sheet in the auxiliary pile is more securely held when the flyer, rake or the like for auxiliary-pile formation is inserted, so that, primarily, the processing of lighter grades of paper can be improved and can be performed with greater accuracy.

In accordance with another and preferred feature of the invention, the suction-type grippers are movable parallel to an upper side of the sheet pile, and drive means are included for inserting the suction-type grippers into the sheet feed, the sheet-stretching means comprising a differential drive independent of the gripper-inserting drive means.

In such an arrangement, the drive for the insertion motion and return motion of the catch fingers can remain unchanged, so that it is necessary only to install a small pneumatic cylinder as an additional differential drive for sheet tautening or stretching between drive members which transmit the motor drive for the insertion and return motions from larger pneumatic cylinders to the catch fingers.

In order to adapt to the possible differences in the amount by which the sheet is shortened in those cases wherein different grades of paper and different press speeds are used, the stroke motion of the pneumatic cylinders for the differential drive both of the catch fingers for the front or leading edge of the sheet and also of the catch fingers for the rear or trailing edge of the sheet is advantageously adjustable.

In accordance with yet another feature of the invention, the differential drive comprises stroke-adjustable pneumatic cylinders, and the gripper-inserting drive means comprise two components mutually connected by the pneumatic cylinders. In accordance with yet a further feature of the invention, the suction-type grippers have a tubular construction with suction nozzles disposed at free ends thereof and are attached at the other ends thereof to a carrier tube and a line connected via control valves to a suction-air system of the printing machine.

In accordance with yet an added feature of the invention, there are provided guide means, the suction-type grippers being movable on the guide means parallel to an upper side of sheet and being formed of catch fingers having suction nozzles disposed at respective free ends thereof in vicinity of a location at which a sheet is deposited, a transverse shaft carrying the pile stops, and drive means for extending and withdrawing the suction-type grippers and for extending and retracting the pile stops, the drive means comprising separate motorized drives formed of pneumatic cylinders and active with mutual dependence, and further including another pneumatic cylinder having a separate control and serving as a transmission member between the suction-type grippers and the first-mentioned pneumatic cylinders for driving the latter on each side of the printing machine.

In accordance with an additional feature of the invention, there is provided a motorized drive including a pneumatic cylinder for driving the second suction-type grippers for the trailing edge of the sheet, a gear transmission unit connected to and between the motorized drive and the second suction-type grippers, the gear transmission unit comprising an input gear rack, an output gear rack and intermediate gearwheels, and another pneumatic cylinder serving as a differential drive in a region of linearly moving parts.

In accordance with a concomitant feature of the invention, the other pneumatic cylinder serving as a differential drive connects a piston rod of the first-mentioned cylinder to the input gear rack of the gear transmission unit for transmitting force in axial direction.

Other features which are considered as characteristic for the invention are set forth in the appended claims.

Although the invention is illustrated and described herein as embodied in a sheet feeder for printing machines and the like, it is nevertheless not intended to be limited to the details shown, since various modifications and structural changes may be made therein without departing from the spirit of the invention and within the scope and range of equivalents of the claims.

Figure 1B:
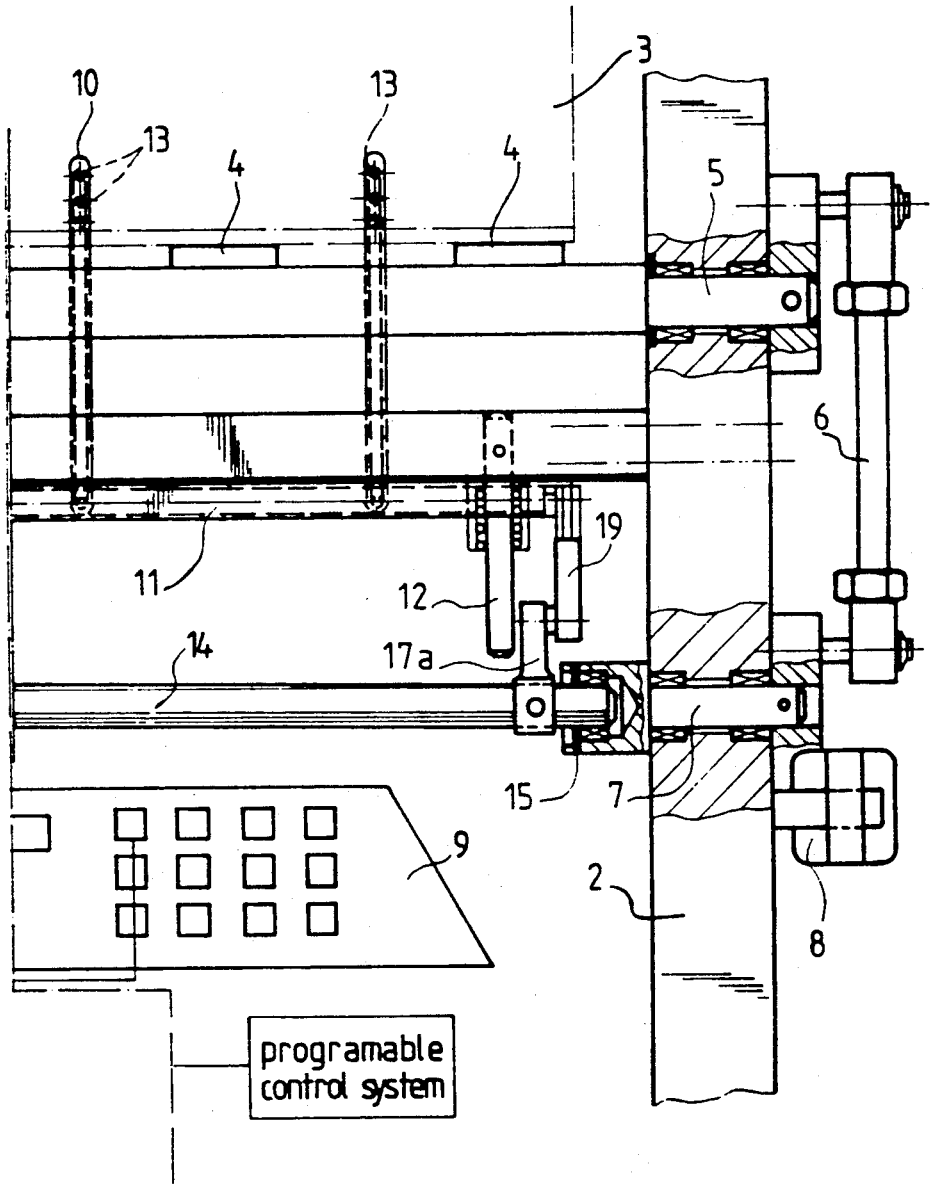
Figure 2A:
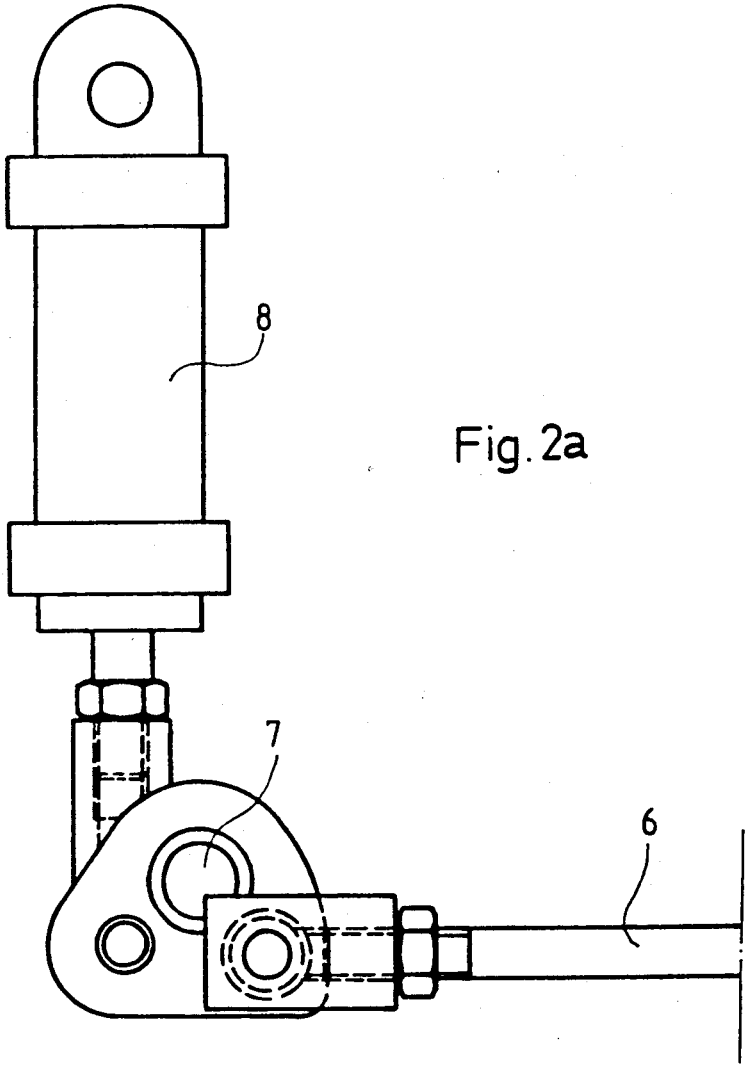
Figure 2B:
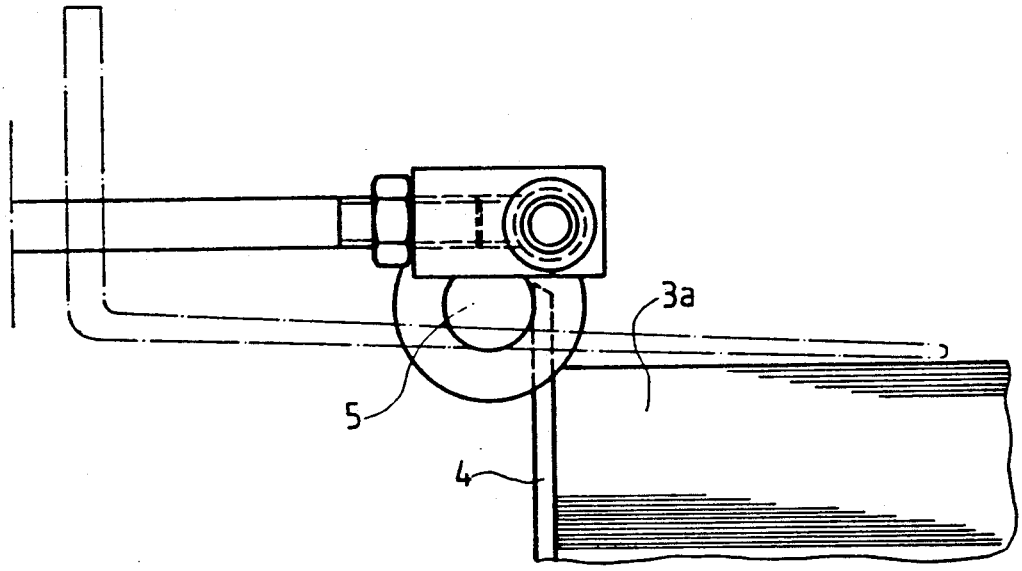
Figure 3A:
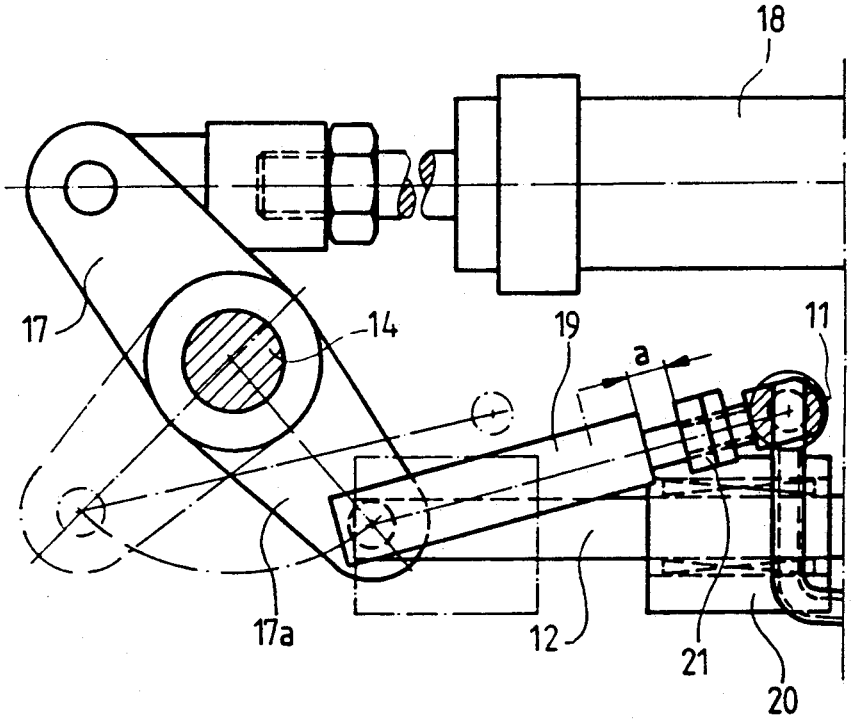
Figure 3B:
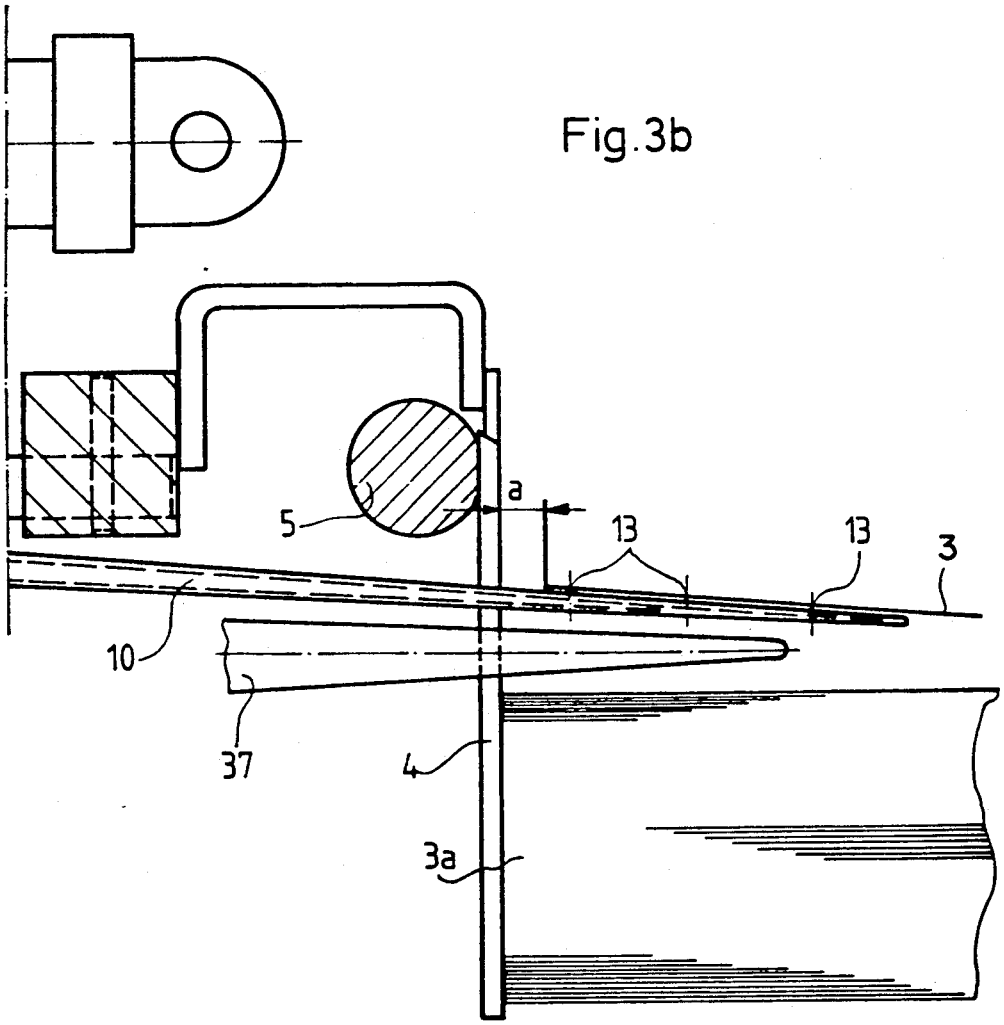
Figure 4:
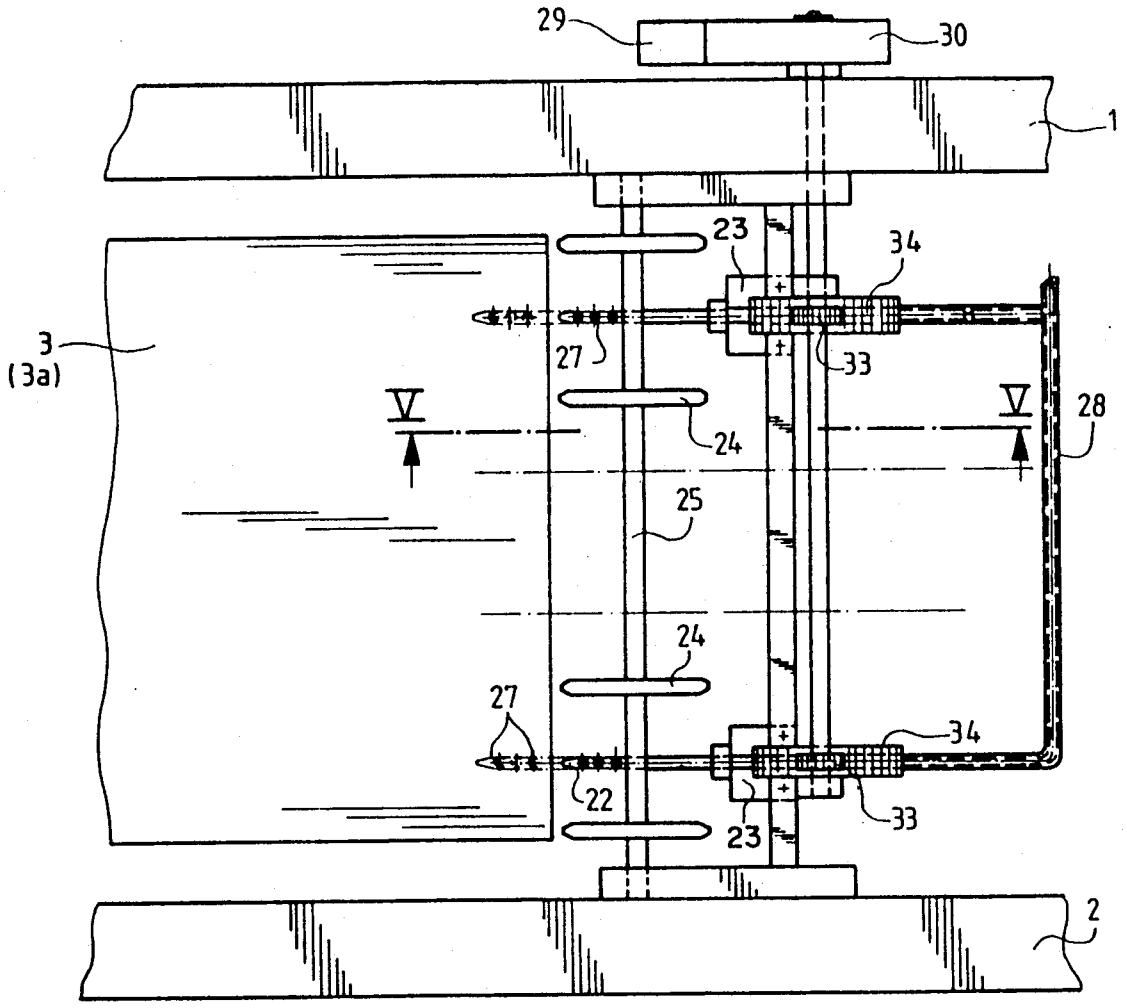
Figure 5A:
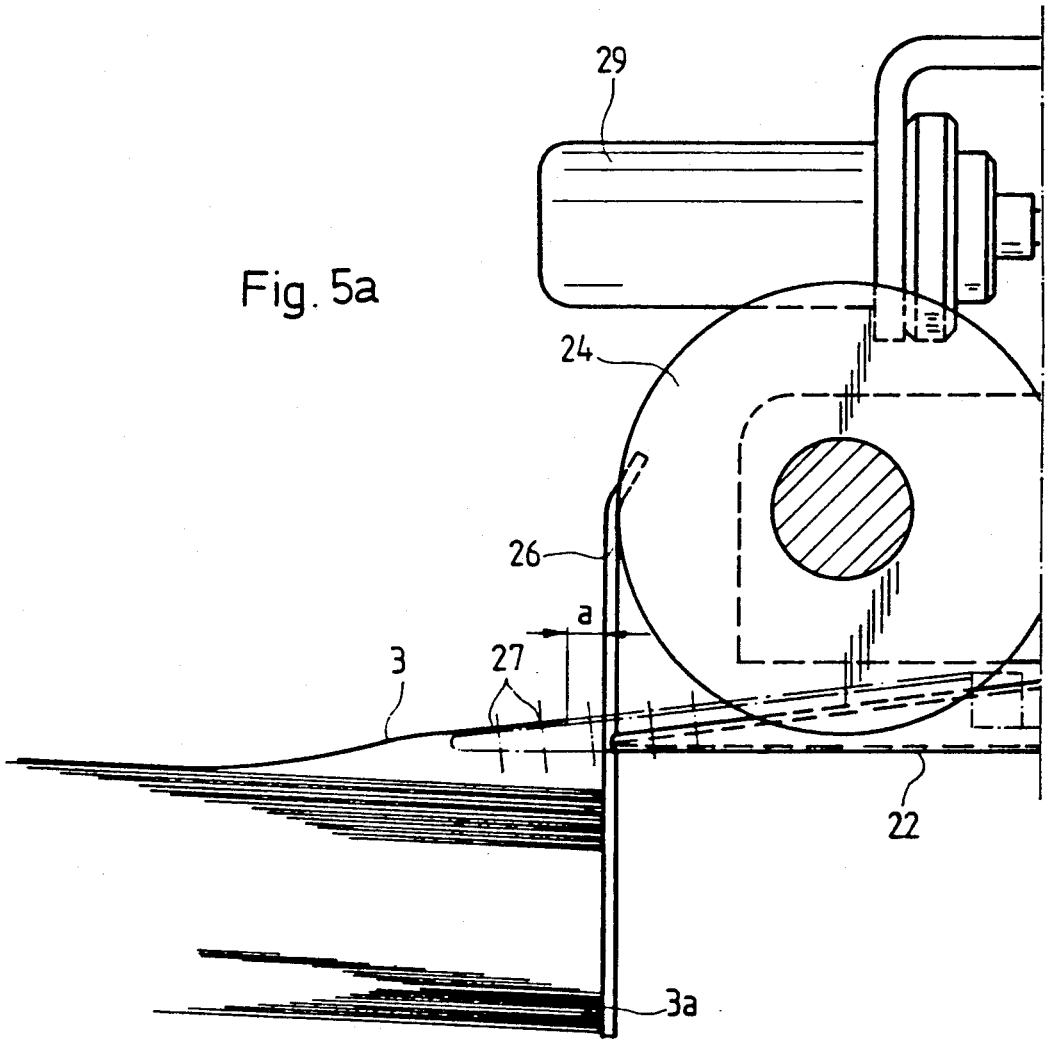
Figure 5B:
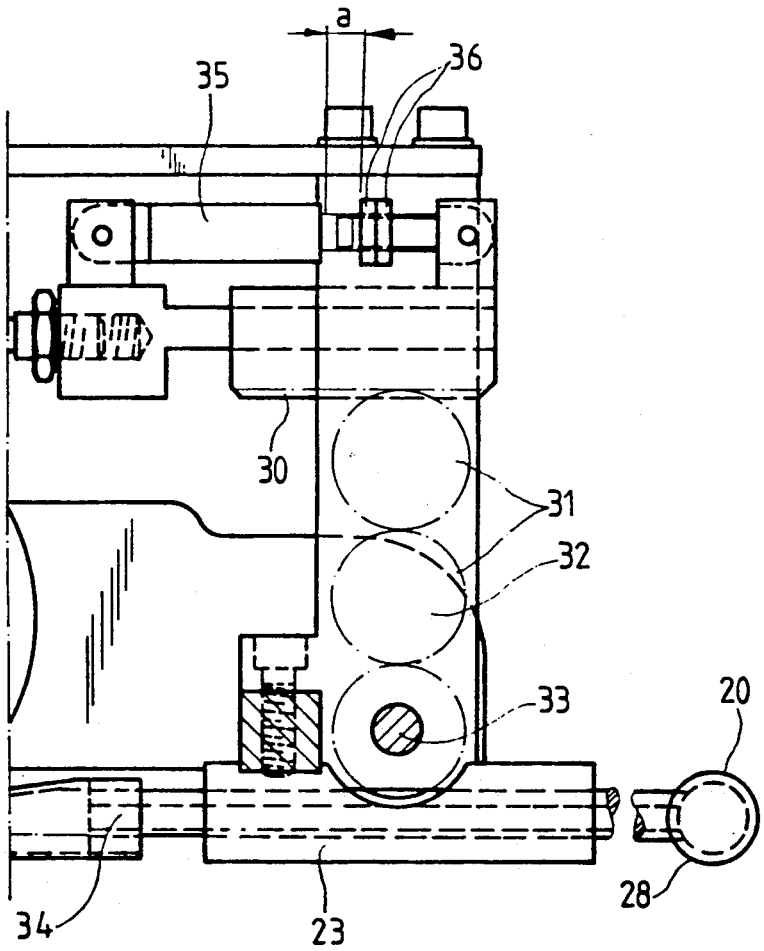

The construction and method of operation of the invention, however, together with additional objects and advantages thereof will be best understood from the following description of specific embodiments when read in connection with the accompanying drawings, in which:

FIGS. 1*a* and 1*b* together form a top plan view of suction-type grippers and pile stops for a front or leading edge of sheets, and drives therefor in a sheet delivery according to the invention;

FIGS. 2*a* and 2*b* together form an enlarged right-hand side elevational view of FIG. 1*b*, showing the drive for the pile stops;

FIGS. 3*a* and 3*b* together form an enlarged fragmentary longitudinal sectional view of FIG. 1*a*, with the side wall removed showing the drive for the suction-type grippers;

FIG. 4 is a top plan view, in reduced scale, of the sheet delivery of FIG. 1, rotated counter-clockwise through 90° and showing suction-type grippers for the rear or trailing edges of the sheets; and FIGS. 5*a* and 5*b* together form an enlarged longitudinal sectional view of FIG. 4 taken along the line V—V in the direction of the arrows.

Referring now to the drawings and, first, particularly to FIGS. 1*a* and 1*b* thereof, there are shown, in a frame formed by two side walls 1 and 2 of the sheet delivery of a printing press, incoming sheets 3 transported to a location above a sheet pile 3*a* (FIG. 2*b*) and against pile stops 4 for the front or leading edge of the sheets. The pile stops 4 are attached to a transversely disposed swivel shaft 5 so that, by means of a rotary movement of the swivel shaft 5, the pile stops 4 can be retracted and again extended. The swivel shaft 5 extends out through the side wall 2 on one side of the printing press and is connected by transmission members 6 to a drive shaft 7 for a motor drive made up of a pneumatic cylinder 8, which permits the pile stops 4 to be retracted and extended again.

In the vicinity of the front or leading edge of the sheets 3 in the sheet pile 3*a* (FIG. 2*b*), suction-type grippers 10 in the form of tubular catch fingers are attached to a carrier tube 11, which extends across the width of the pile and is guided so as to be movable backwards and forwards on guides 12 which are aligned parallel to the plane of the sheets in the sheet pile 3*a*, so that, as they move, the suction-type grippers 10 execute a precisely defined linear motion. The tubular catch fingers of the suction-type grippers 10 are provided with suction nozzles 13 at the free ends thereof which are insertable above the pile and which form at the upper sides thereof, a support for a sheet 3. The suction nozzles 13 are connected to the suction-air system of the printing press through the interior of the tubular catch fingers and the carrier tube and through suitably constructed control devices, e.g., aided by pneumatically or electrically microprocessor-controlled valves. The suction-type grippers 10 are likewise driven by a drive shaft 14, which is articulatingly coupled with the carrier tube 11 and is mounted coaxially with the drive shaft 7 for the pile stops 4. One end of the drive shaft 14, adjacent the side wall 2, is rotatably supported in a bearing 15 provided on the drive shaft 7. The other end of the drive shaft 14 is supported in a bearing 16 in the side wall 1 and is articulatingly connected outside the side wall 1 to a piston rod of a pneumatic cylinder 18 by means of one arm of a lever 17 mounted on the drive shaft 14. Mounted within the frame of the printing press on the shaft 14 on each side of the press is a lever 17*a*, which is articulatingly connected to a relatively small pneumatic cylinder 19 having a piston rod which is swivelconnected to the carrier tube 11 or to a slide 20 (FIG. 3*a*) supporting the carrier tube 11 on the guide 12. The pneumatic cylinder 18 permits the suction-type grippers 10 to be inserted and withdrawn, while the two pneumatic cylinders 19 permit the sheet to be tautened or stretched by the limited withdrawal of the suction-type grippers 10 in a direction towards the pile stops 4. This limited motion is adjustable by means of an adjusting screw 21 (FIG. 3*a*) which is turnable on the piston rod of the pneumatic cylinders 19 and by which the maximum piston stroke of the pneumatic cylinders 19 is controllable.

As shown in FIG. 4, in the vicinity of the rear or trailing edge of the sheets 3 in the sheet pile 3*a*, suction-type grippers 22 are disposed on guides 23 (FIG. 5*b*) so as to be movable linearly between suction discs 24 of a suction roller 25, from which stops 26 (FIG. 5*a*) for the rear or trailing edge of the sheets extend vertically downwardly into the vicinity of the sheet pile 3*a*.

The suction-type grippers 22 are constructed likewise tubularly in the form of catch fingers and, in the region in which they are insertable above the sheet pile 3*a*, on the upper sides thereof which serve as a support for the sheets, are provided with suction nozzles 27, which are connected to the suction-air system of the printing press through the hollow catch fingers, a common supply line 28 and suitable controlled control valves which are controlled, for example, pneumatically or electrically, e.g. by microprocessors. The suction-type grippers 22 are driven by a pneumatic cylinder 29 having a piston motion which is transmitted to the suction-type grippers 22 by an input gear rack 30, intermediate gearwheels 31, 32 and 33 and an output gear rack 34, so that the suction-type grippers 22 can be inserted and withdrawn linearly with the suction nozzles 27 above the rear or trailing edge of the sheet pile. In order to tauten or stretch the sheets by means of forces acting upon the rear or trailing edge of the sheets, the piston rod of the pneumatic cylinder 29 is guided so as to be axially movable in the body of the gear rack 30 and is connected to the gear-rack body by a small pneumatic cylinder 35 having a housing which is articulatingly connected to the piston rod which, in turn, is articulatingly connected to the body of the gear rack 30. To adjust the stroke motion of the small pneumatic cylinder 35, adjusting screws 36 are provided, which are turnably arranged on a thread of the piston rod.

The pneumatic cylinders 18 and 29 for the drive of the suction-type grippers 10 for the front or leading edge of the sheets can be operated independently or, alternatively, in mutual dependence, via a switch. It is advantageous to provide a control by means of which the suction-type grippers 10 and 22 are first inserted above the sheet pile 3*a* in order then to insert a rake or flyer 37 or, after the pile stops 4 have been retracted, another auxiliary-pile stacking device, such as a board, into the gap between the uppermost sheet on the sheet pile 3*a* and the sheets gripped by the suction-type grippers 10 and 22. Conversely, in the latter case, the pile stops 4 are not retracted again until, or are snapped back before, the auxiliary pile is removed and the suction-type grippers 10 and 22 are withdrawn.

To tauten or stretch the sheets, the afore-described device acts as follows. In the rest position, the pneumatic cylinders 8, 18 and 29 for driving the pile stops 4 for the front or leading edge of the sheets, for the suction-type grippers at the front or leading edge of the sheets and for the suction-type grippers at the rear or trailing edge of the sheets are restricted. The suction-type grippers are thus withdrawn to a location behind the pile stops 4 at the front or leading edge and the pile stops 26 at the rear or trailing edge. The small pneumatic cylinders 19 and 35 are extended. In order to change the pile in non-stop operation, the pneumatic cylinder 18 is initially extended and inserts the suction-type grippers 10 above the sheet pile with the suction nozzles 13 at the front or leading edge of the sheets. Simultaneously, the pneumatic cylinder 29 is extended and inserts the suction-type grippers 22 above the sheet pile from the rear or trailing edge of the sheets with the suction nozzles 27, so that the next incoming sheet 3 is deposited with its front or leading edges onto the suction-type grippers 10 and with its rear or trailing edge onto the suction-type grippers 22, so that the sheet sags at its central region and is supported on the sheet pile (FIG. 5*a*). In doing so, the sheet becomes shorter by the distance a shown, for example, in FIG. 5*a* at the rear or trailing edge. To tauten or stretch the sheet, the small pneumatic cylinders 19 and 35 are then energized so that they extend by the distance a corresponding to the length by which the sheet has become shorter, and tauten or stretch the sheet again so that it reaches and abuts the pile stops 4 and 26. The extent of the tautening or stretching motion is adjustable by means of the adjusting screws 21 and 36, respectively, on the piston rods of the pneumatic cylinders 19 and 29, respectively.

After the pile has been changed, the pneumatic cylinders 8, 18 and 29 for driving the pile stops 4 and the suction-type grippers 10 and 22, respectively, retract again, so that the pile stops 4 are extended and the suction-type grippers 10 and 22 are withdrawn from the vicinity of the sheet pile, and the auxiliary pipe drops onto a new pallet or the like. Simultaneously, the small pneumatic cylinders 19 and 25 are extended in order to re-establish the initial position.

In a manner similar to when the pile is changed, in order to remove sample sheets for assessment, the pile stops 4 are likewise snapped back after the suction-type grippers 10 and 22 have been retracted.

Via a control panel 9, the pneumatic cylinders 8 and 11, for example, can be operated either in mutual dependence or independently of one another. Actuation of the other cylinders can be software-controlled, for example.

We claim:

1. Sheet delivery for a printing machine or the like with a device for changing a sheet pile while the machine is in operation, comprising suction-type grippers insertable into a sheet feeder, opposite to a conveying direction of the sheets and between pile stops for a leading edge of the sheets, said suction-type grippers having means for gripping by suction, in an inserted end position of said grippers, the leading edge of a sheet deposited onto the suction-type grippers and for holding the sheet at a distance above the sheet pile in an auxiliary-pile position, so as to permit the insertion of an auxiliary-pile device beneath the sheet, and means for stretching the sheet after the leading edge of the sheet has been gripped by said inserted suction-type grippers, said sheet-stretching means being effective for withdrawing said suction-type grippers a predetermined distance towards the pile stops for the leading edge of the sheet.

2. Sheet delivery according to claim 1, wherein said suction-type grippers are movable parallel to an upper side of the sheet pile, and including drive means for inserting said suction-type grippers into the sheet feed, said sheet-stretching means comprising a differential drive independent of said gripper-inserting drive means.

3. Sheet delivery according to claim 2, wherein said differential drive comprises stroke-adjustable pneumatic cylinders, and said gripper-inserting drive means comprise two components mutually connected by said pneumatic cylinders.

4. Sheet delivery according to claim 3, wherein said suction-type grippers have a tubular construction with suction nozzles disposed at free ends thereof and being attached at the other ends thereof to a carrier tube and a line connected via control valves to a suction-air system of the printing machine.

5. Sheet delivery according to claim 1, including guide means, said suction-type grippers being movable on said guide means parallel to an upper side of sheet and being formed of catch fingers having suction nozzles disposed at respective free ends thereof in vicinity of a location at which a sheet is deposited, a transverse shaft carrying the pile stops, and drive means for extending and withdrawing said suction-type grippers and for extending and retracting the pile stops, said drive means comprising separate motorized drives formed of pneumatic cylinders and active with mutual dependence, and further including another pneumatic cylinder having a separate control and serving as a transmission member between said suction-type grippers and said first-mentioned pneumatic cylinders for driving the latter on each side of the printing machine.

6. Sheet delivery for a printing machine or the like with a device for changing the sheet pile while the machine is in operation, comprising first suction-type grippers formed as catch fingers for a leading edge of a sheet and being insertable between pile stops of the sheet, and second suction-type grippers formed as catch fingers for a trailing edge of the sheet, both said first and said second suction-type grippers being insertable above a sheet pile parallel to a conveying direction of the sheet and having means for gripping and holding, in an inserted end position of both said first and said second suction-type grippers, a sheet deposited at its leading and trailing edges thereon, for forming an auxiliary pile above the sheet pile, said first and said second suction-type grippers having suction nozzles at upper sides thereof whereon the sheet edges are deposited, and having sheet-stretching means for withdrawing said first and said second suction-type grippers from said inserted end position thereof a given distance in a direction opposite to the direction of insertion thereof.

7. Sheet delivery according to claim 6, including a motorized drive including a pneumatic cylinder for driving said second suction-type grippers for the trailing edge of the sheet, a gear transmission unit connected to and between said motorized drive and said second suction-type grippers, said gear transmission unit comprising an input gear rack, an output gear rack and intermediate gearwheels, and another pneumatic cylinder serving as a differential drive in a region of linearly moving parts.

8. Sheet delivery according to claim 7, wherein said other pneumatic cylinder serving as a differential drive connects a piston rod of said first-mentioned cylinder to said input gear rack of said gear transmission unit for transmitting force in axial direction.

* * * * *